United States Patent [19]

Myers

[11] Patent Number: 4,750,627

[45] Date of Patent: Jun. 14, 1988

[54] ARTICLE SUPPORT STRUCTURE HAVING ASJUSTABLY POSITIONABLE MEMBERS

[76] Inventor: Valerie L. Myers, 4325 Dancy Blvd., Westland, Mich. 48185

[21] Appl. No.: 850,737

[22] Filed: Apr. 14, 1986

[51] Int. Cl.[4] ..... A47B 47/00

[52] U.S. Cl. ..... 211/205; 211/163; 211/175

[58] Field of Search ..... 211/205, 167, 163, 204, 211/175, 203, 196; 248/131, 425

[56] References Cited

U.S. PATENT DOCUMENTS

| | | | |
|---|---|---|---|
| 363,081 | 5/1887 | Pickett | 211/196 |
| 445,633 | 2/1891 | Becker | 211/205 X |
| 460,876 | 10/1891 | Kurth | 211/205 X |
| 3,204,779 | 9/1965 | Warner | 211/205 X |
| 3,246,768 | 4/1966 | Carlos | 211/204 |
| 3,310,180 | 3/1967 | Neagle | 211/205 |
| 3,805,965 | 4/1974 | Champagne | 248/131 X |
| 4,252,242 | 2/1981 | Tudor | 211/104 X |

*Primary Examiner*—Ramon S. Britts
*Assistant Examiner*—Blair M. Johnson
*Attorney, Agent, or Firm*—Rhodes and Boller

[57] ABSTRACT

An article support structure for supporting various articles such as plants, clothes, towels, etc. comprises a main vertical upright having a series of vertically spaced, horizontally extending through-holes arranged at different angles about the axis of the main vertical upright. Horizontal rods extend through the through-holes so as to be adjustably positionable through the through-holes, and hence relative to the main vertical upright. The main vertical upright provides one point of support for each rod and a further vertical support for each rod is provided by an auxiliary vertical upright which is joined to the rod in horizontally spaced relation to the support provided by the main upright, preferably at the distal end of the rod. The main upright may be constructed in a manner in which the through-holes are arranged at fixed angular relationships to each other. Another embodiment comprises the through-holes in individual sections of the upright which are individually adjustable to different angular relationships. The auxiliary uprights may be supported via rollers to faciliate adjustable positioning form one configuration to another. The support may also have decorative lighting incorporated into it.

7 Claims, 5 Drawing Sheets

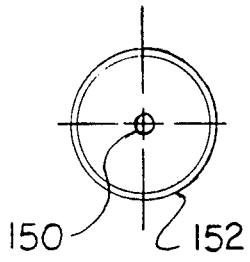
FIG. 17
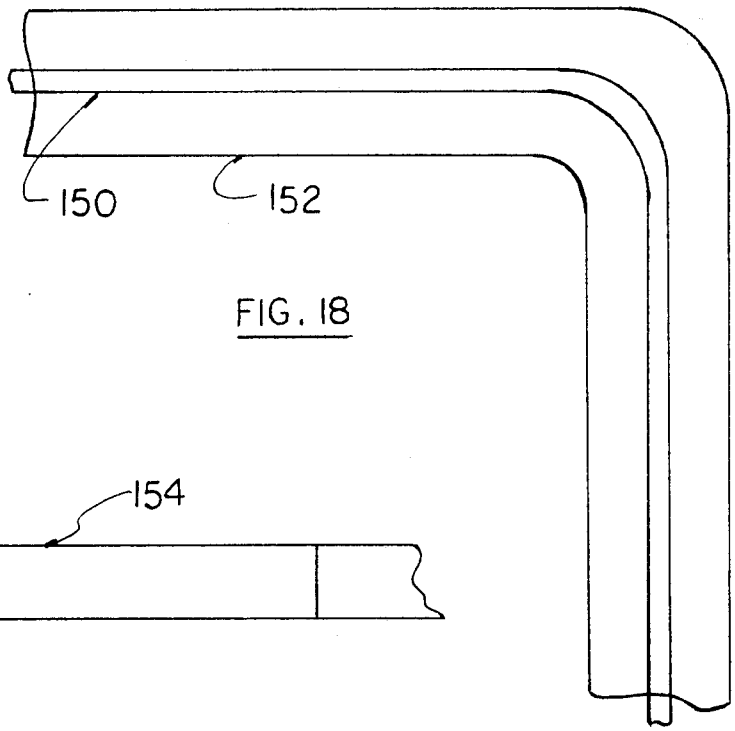
FIG. 18
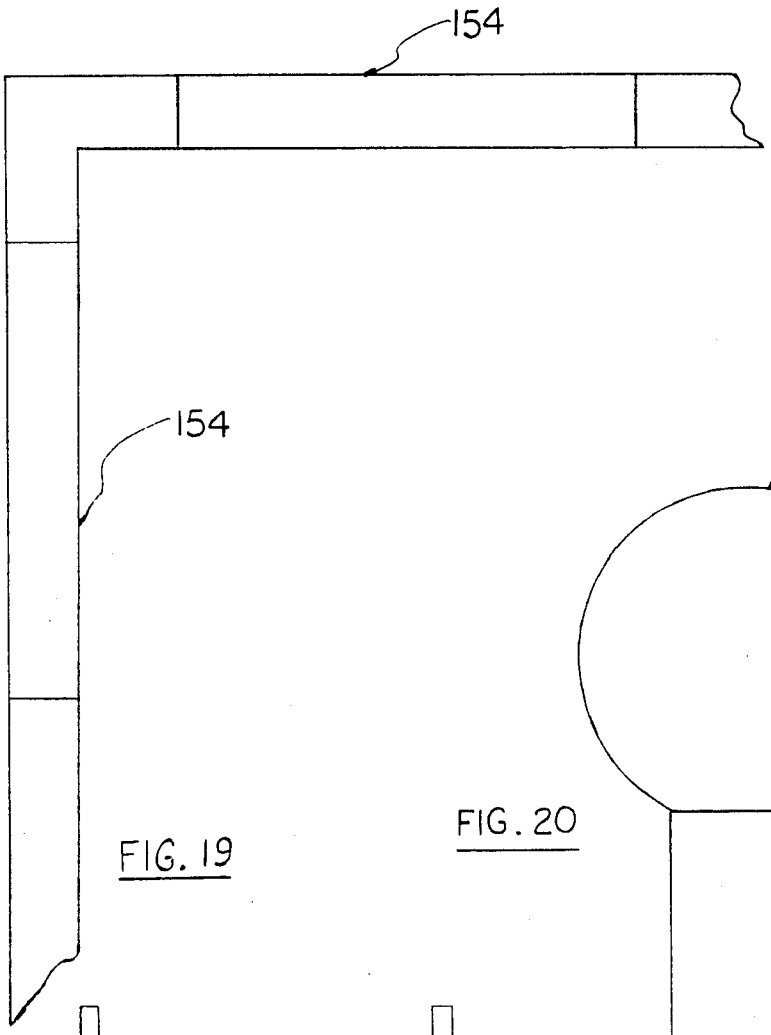
FIG. 19
FIG. 20

ARTICLE SUPPORT STRUCTURE HAVING ASJUSTABLY POSITIONABLE MEMBERS

INTRODUCTION

This invention relates generally to article support structures. Specifically it relates to a support in which members are positionable to different configurations so as to render the support adaptable to different needs.

Supports of the general type to which the present invention relates are used both in the home and commercially. Such supports can be both functional and decorative, Examples are supports for hanging plants and for soft goods, such as clothes, towels, or the like. An example of a commercial use is as a display for displaying various types of merchandise.

Many supports have fixed geometrical configurations, and hence are not adaptable to different needs. For example a support which fits in one location may not fit in a different location. Thus the extent to which such a support can be used is somewhat restricted.

It is also advantageous to have a support which is free-standing, meaning one which does not necessarily require attachment to its surroundings, such as to a floor or wall.

The present invention comprises a new and improved article support structure with adjustable members which allows the support structure to assume different geometrical configurations. It can be adapted to a user's particular requirements by convenient adjustment. This means that a support has the potential for more uses than prior supports. Because the support can be free-standing, convenience and adaptability of use are further enhanced. Furthermore, the support structure can be fabricated from conventional parts, and this means that relatively inexpensive models of the support can be made. The support is however adaptable to embodiment in more elaborate models which may enhance the utility and decorative character.

Briefly, the present invention comprises a new and improved article support structure in which a main vertical upright is provided with a series of vertically spaced horizontally extending through-holes arranged at different angles about the axis of the main upright. A series of horizontal rods extend through the through-holes in the main vertical upright. These horizontal rods are adjustably positionable within the through-holes. In addition to the support provided by the main vertical upright, each rod is provided with further vertical support by a corresponding auxiliary vertical upright which provides vertical support in horizontally spaced relation to the support provided by the main upright. Thus the support structure comprises horizontal and vertical members on which various articles can be supported. The articles may be directly supported on the members, or alternatively may be supported by intermediate means such as hooks, coat hangers or the like.

The foregoing features of the invention will be described with reference to the accompanying drawings which illustrate several embodiments of the invention according to the best means contemplated at the present time for the invention.

DESCRIPTION OF DRAWINGS

FIGS. 17 through 20 illustrate further modifications.

DETAILED DESCRIPTION

Figure 1:
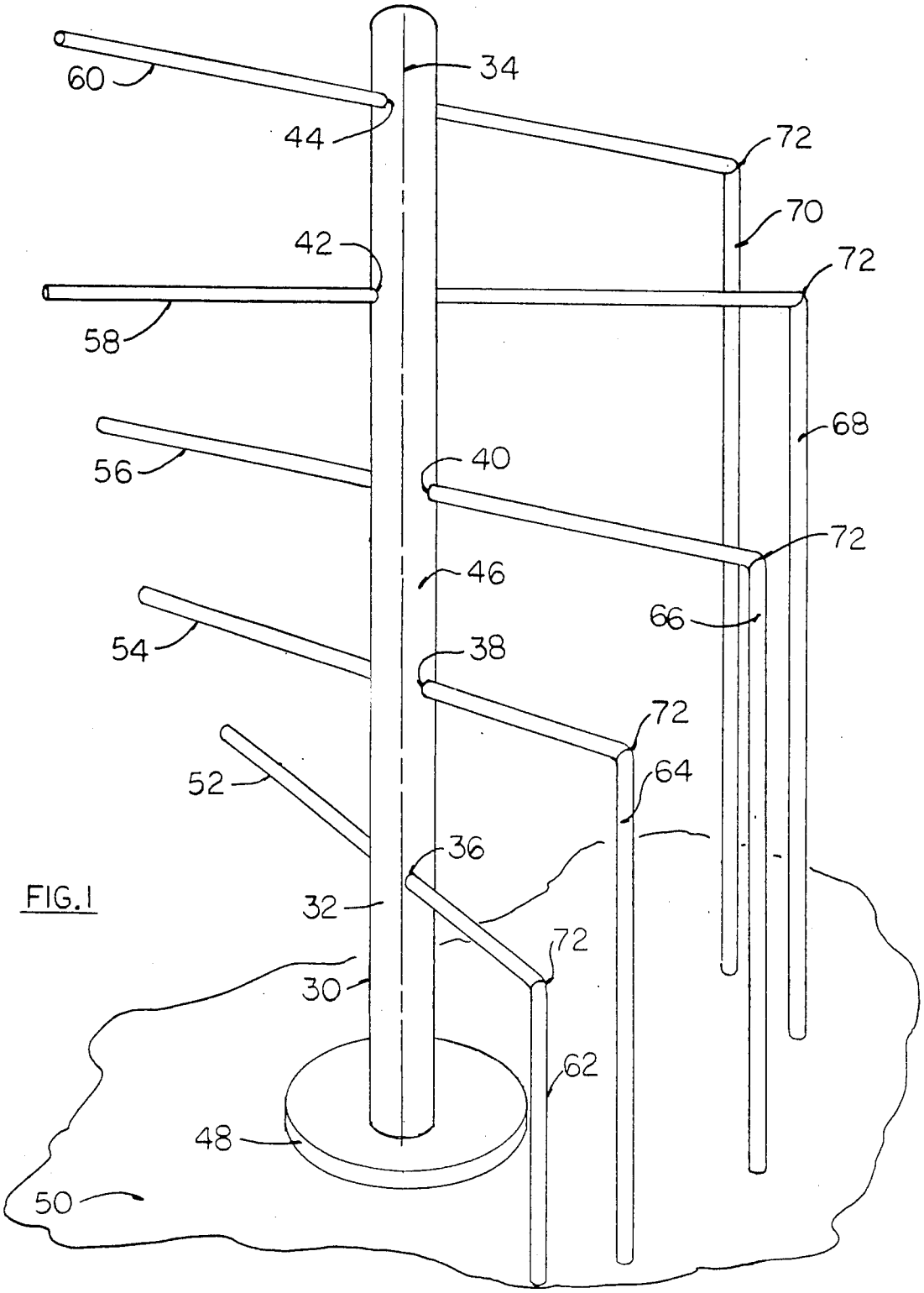
FIGS. 1, 2, and 3 are perspective, top plan, and front elevation views respectively of a support structure constructed in accordance principles of the invention.
Figure 2:
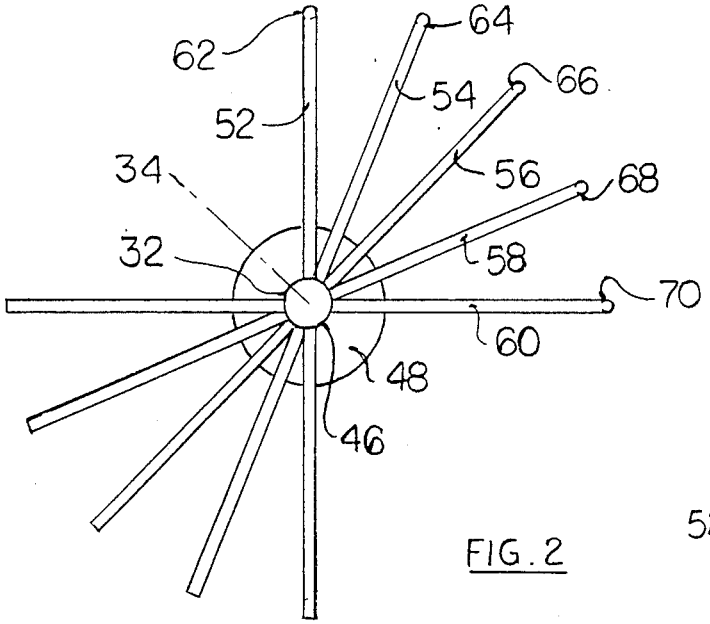
Figure 3:
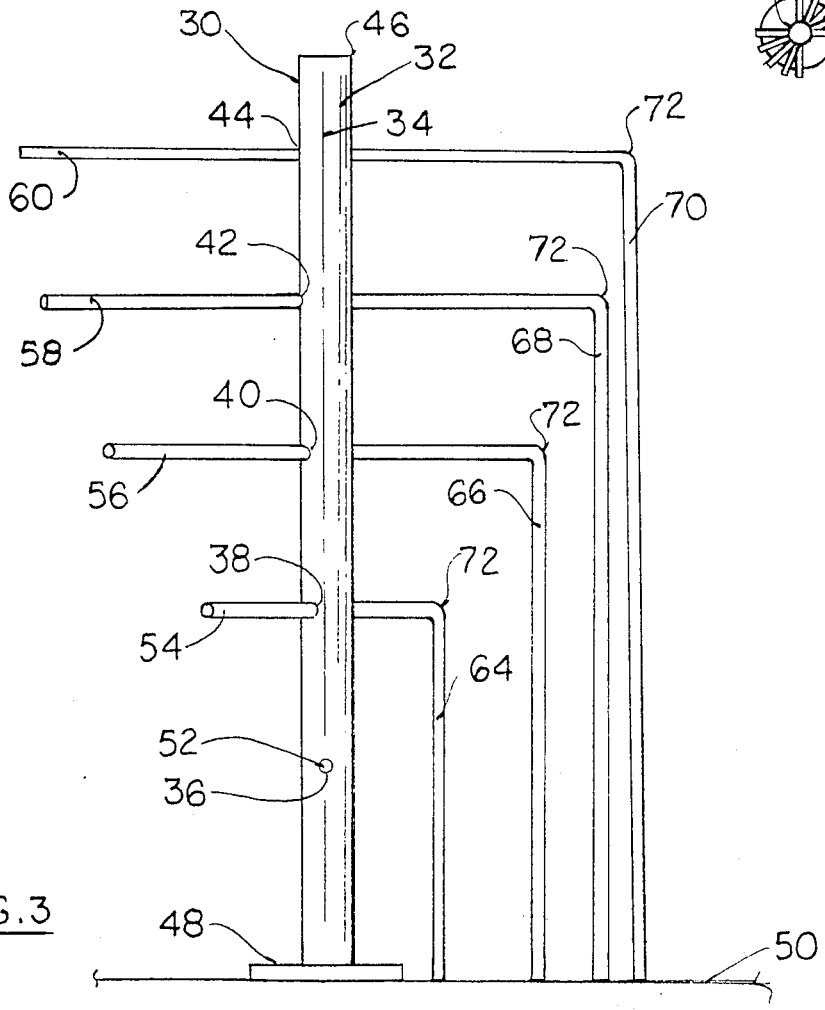

FIGS. 1, 2 and 3 illustrate an article support structure 30 constructed in accordance with principles of the invention. Support 30 comprises a main upright 32 which has a series of vertically spaced horizontally extending through-holes arranged at different angles about the main vertical axis 34 of upright 32. The particular support which has been illustrated has five through-holes identified by the respective numbers 36, 38, 40, 42, and 44. The through-holes are arranged at regular intervals both vertically along the length of axis 34 as well as angularly about axis 34. As best seen perhaps in FIG. 2, each succeeding through-hole has its axis at an angle 22½° more clockwise than the preceeding hole in ascending order up axis 34. For reasons of symmetry, the axis of each through-hole 36, 38, 40, 42 and 44 perpendicularly intersects axis 34.

Upright 32 comprises the form of a circular cylindrical post 46 which is uprightly supported on a circular base 48 which of somewhat larger diameter. This endows the post with a better degree of support on an underlying horizontal support surface, such as a floor 50. It is to be appreciated however that this particular illustrated construction for upright 32 is merely representative. A typical height for the upright may be on the order of feet and a typical height may be in the range of from 1 to 7 feet. The upright may be fabricated of any conventional material, wood, metal, or synthetic.

A horizontal rod extends through each of the throughholes 36, 38, 40, 42, and 44, and these rods are identified by the corresponding reference numerals 52, 54, 56, 58, and 60. In the support which has been illustrated, the rods 52, 54, 56, 58, 60 are of equal length, but this is merely representative and rods having unequal lengths may also be employed in any given design if desired. The rods are of circular shape so as to have a free sliding fit through the through-holes in upright 32.

In addition, each rod is provided with additional vertical support by a corresponding vertical auxiliary upright, and they are identified by the respective numbers 62, 64, 66, 68, and 70. In the illustrated construction each auxiliary upright connects to one distal end of the corresponding horizontal rod at a fixed joint 72 but once again this is merely a representative construction.

The height of each auxiliary upright corresponds essentially to the distance that the associated through-hole is located above the floor 50. In this way each horizontal rod shares a common vertical support with the other rods on upright 32, but each rod is endowed with its own individual auxiliary support at a spaced distance from the vertical support provided by upright 32.

The rods, auxiliary uprights, and joints may be fabricated in any conventional manner. The illustrated embodiment shows the auxiliary uprights to be round bars of the same diameter as the horizontal rods. They may be in the form of wood dowels, or alternatively of metal or a synthetic material.

In the illustrated embodiment the rods span two 90° quadrants as viewed in FIG. 2, one quadrant being from 12 o'clock to 3 o'clock and the other from 6 o'clock to 9 o'clock. The vertical uprights are all located in the same quadrant which in FIG. 2 would extend from 12 o'clock to 3 o'clock.

Figure 4:
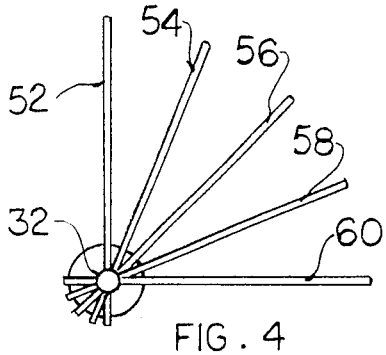
FIG. 4 is a view similar to FIG. 2 but on a reduced scale and showing an alternate configuration to illustrate the adjustable capability of the support structure according to the invention.

Because the horizontal rods may be adjustably positioned within their respective through-holes in upright 32, the support is endowed with an adaptability to fit the needs of different uses. Hence although FIGS. 1, 2, and 3 illustrate the rods in a symmetrical pattern with respect to main upright 32, meaning that half of each rod is to one side of the upright and the other half to the diametrically opposite side, the rods can be repositioned to a multitude of alternate configurations. One such alternate configuration is portrayed on a reduced scale in FIG. 4 where it can be seen that the rods have been repositioned such that a longer segment of each rod is between upright 32 and the corresponding auxiliary upright than the segment which projects from the diametrically opposite side of upright 32.

Figure 5:
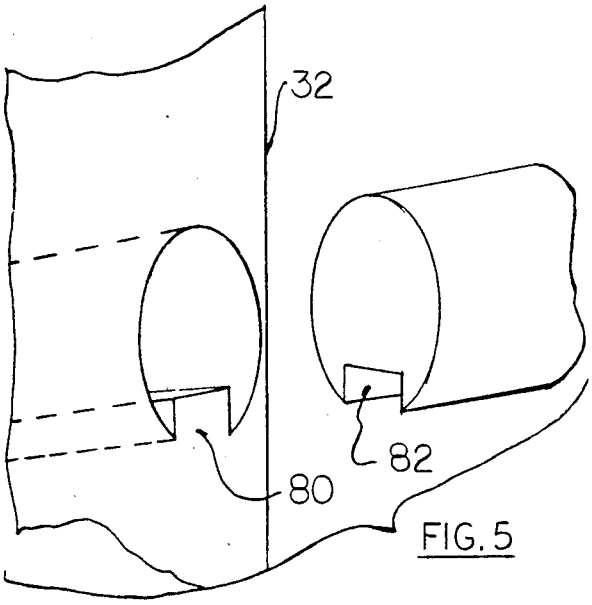
FIG. 5 is a fragmentary perspective view illustrating a modification to a portion of the support.

FIG. 5 illustrates a modification of a through-hole in upright 32 which prevents rod from being rotated about its coaxis with the through-hole. This is accomplished by a horizontal key and keyway construction with the illustrated embodiment having a key 80 in the through-hole and a keyway 82 in the horizontal rod. Thus the rod can still slide with respect to the through-hole but the rod cannot be rotated about its coaxis with the through-hole. This feature may be convenient for certain uses. By providing the key and keyway at the bottom, the top portion of the rod retains a smooth circular shape.

Figure 6:
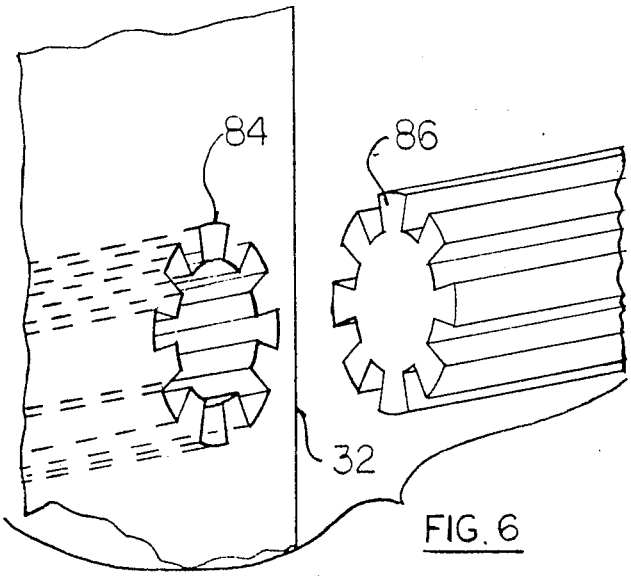
FIG. 6 is a fragmentary perspective view illustrating another type of modification.

FIG. 6 illustrates another way in which relative rotation of a rod with its through-hole may be prevented while still permitting the rod to slide through the through-hole. This is acconplished by interfitting splines 84 and 86. In this version the entirety of the horizontal rod contains the spline section 86 but it will be appreciated that full positional capability of a rod with respect to a through hole is not required. In other words such a splined, or other type of rotation-preventing section, may occupy less than the full length of a horizontal rod. In any given embodiment of the invention the adjustability of any horizontal rod may take place over less than the full extent of its length although full adjustability will provide the greatest ability of adaptation of the support to various uses.

Figure 7:
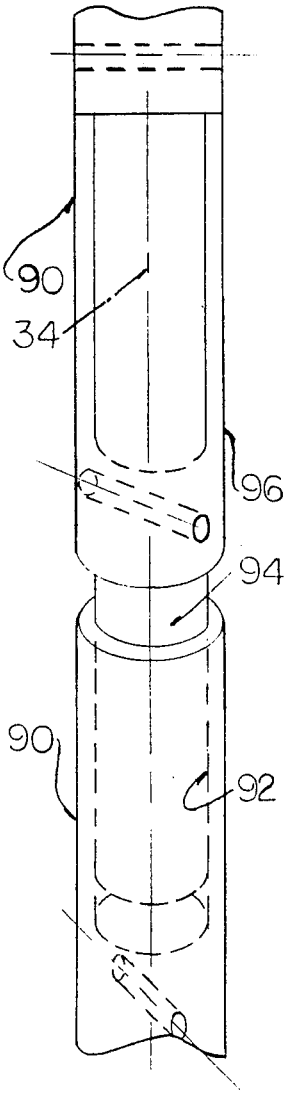
FIGS. 7 and 8 are views illustrating a modification to another portion of the support, FIG. 7 being during the modification and FIG. 8 being a front elevational view of the modification.
Figure 8:
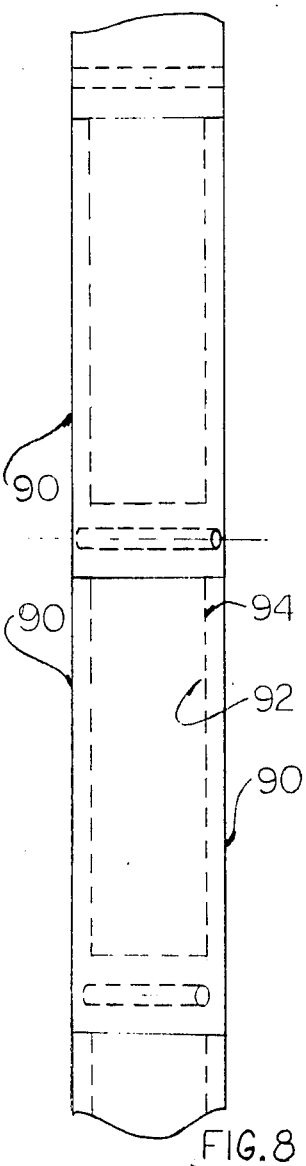

In support 30 the through-holes are in a fixed relationship to each other on the upright. The through-holes may be placed in an adjustable relationship by constructing the upright of individual sections. For example each through hole could be provided in a separate section of the upright with the sections fitting together in an end-to-end relationship to form the upright. FIGS. 7 and 8 portray a construction in which each throughhole is provided in its own individual section 90. Each section is angularly positionable independently of the others about axis 34. The illustrated construction shows that each section 90 is constructed of an upper portion 92 containing an upwardly open tube and a lower portion 94 which fits into the upper portion 92 of the section 90 just below it. The portion 96 of each section which contains the through-hole is shown to be solid except for the through-hole.

Figure 9:
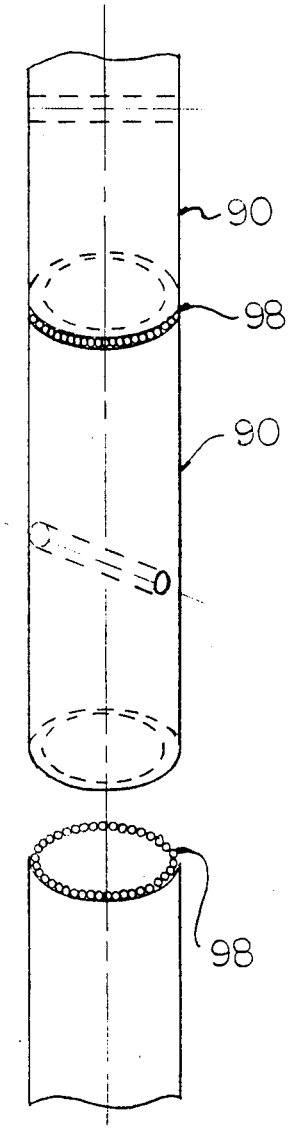
FIG. 9 is a fragmentary perspective view similar to FIGS. 7 and 8 illustrating a further modification of the same portion of the support.

FIG. 9 portrays a modified form in which the ability to angularly position each individual section 90 is enhanced by utilizing some form of low friction mechanism such as a set of roller bearings 98 between the individual sections.

Figure 10:
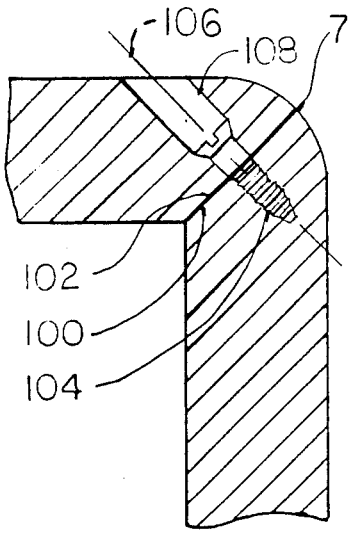
FIG. 10 illustrates a more detailed representative construction for of the support.

FIG. 10 illustrates detail of one possible form for joint 72. The distal end of the horizontal rod and the upper end of the auxiliary upright are cut at complementary 45° angles to form surfaces 100, 102 which are placed flat against each other so that the rod and auxiliary upright are at 90°. A screw 104 is passed through the rod and upright along an axis 106 which is perpendicular to the two surfaces 100, 102 and located centrally. The screw serves to securely join the rod and the upright and the head of the screw is disposed in a countersunk hole 108 so that it does not protrude from the surface. This particular joint of FIG. 10 is intended to be a more or less permanent joint although it is to be appreciated that the screw could possibly be removed.

Figure 11:
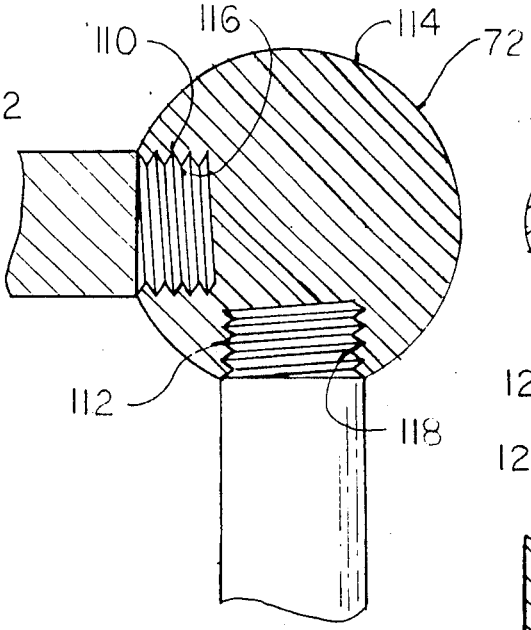
FIG. 11 is a fragmentary. view partly in section illustrating a further alternate detail.

FIG. 11 illustrates another form for joint 72 in which the ends of the horizontal rod and the auxiliary upright contain screw threads 110, 112 concentric with their respective axes. A connector 114 contains complimentary threaded holes 116, 118 at 90° angles to each other and extending into the connector from the exterior surface. The threaded ends of the rod and upright thread into these two holes. In this embodiment the joint can be disassembled conveniently by unscrewing either the rod or the vertical upright from the connector and in most instances it will be more convenient to unscrew the vertical upright if disassembly is desired.

Figure 12:
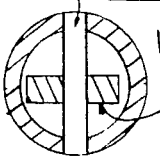
FIGS. 12, 13 and 14 are fragmentary views, namely a horizontal plan sectional view, a partial vertical elevational view from one side, and a vertical sectional view at 90° to the preceding view, respectively, illustrating a further improvement which may be incorporated into a support.
Figure 13:
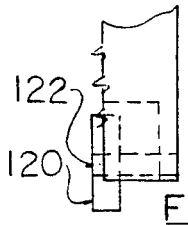
Figure 14:
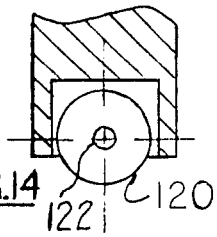

FIGS. 12, 13, and 14 illustrate detail of a modification which may be made to any of the auxiliary uprights. The modification comprises the inclusion of a roller 120 at the lower end of the support is to be readjusted, the roller will roll along surface 50. Depending upon the specific configuration of the support, the roller may be arranged to roll radially with respect to axis 34 of main vertical upright when the corresponding auxiliary upright and its horizontal rod are readjusted through the corresponding through-hole in the main upright. The roller can also be arranged to roll in a circle about axis 34 when, for example, one of the sections containing the corresponding through-hole is rotated about axis 34.

The illustrated embodiment of FIGS. 12, 13, and 14 shows a single roller wheel 120 which is supported on an axle 122 mounted in the lower end of the auxiliary vertical upright. When the axle 122 is disposed parallel to the length of the corresponding horizontal rod to which the auxiliary upright is connected, it will support the circular motion about the main upright. Wben the axle 122 is repositioned at 90° from the view in FIG. 12, it will support radial motion. There could be a pivot joint to enable the roller and axle to pivot about the axis of the auxiliary upright or it could take the form of a caster type construction. The use of a roller is advantageous where the configuration of the support is to be changed while the support is supporting articles, especially heavy ones.

Figure 15:
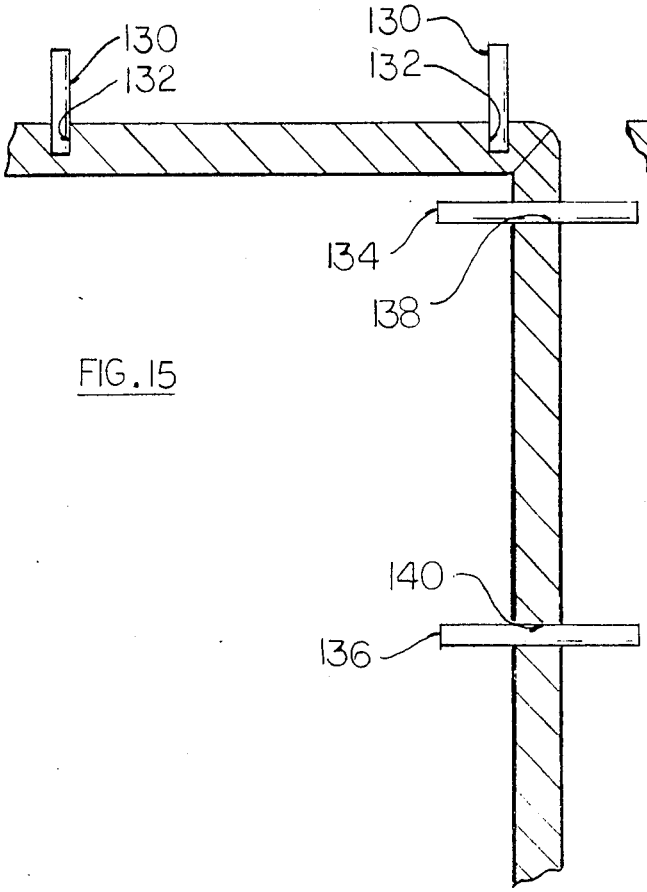
FIGS. 15 and 16 are fragmentary sectional views illustrating further details of modifications.

FIG. 15 illustrates a further modification to a horizontal rod and vertical upright where pegs are cooperatively associated with each. In FIG. 15 two upright vertical pegs 130 are inserted into holes 132 in the top of the horizontal rod and these pegs are horizontally spaced apart. They can take the form of removable pins or dowels. Likewise the vertical auxiliary upright is shown to contain a pair of pegs 134, 136 which are passed through through-holes 138, 140 in the auxiliary vertical upright. The pegs can be used to assist in the support of articles. While the pegs in the horizontal rod may restrict the extent to which the rod can slide through the corresponding through-hole in the main vertical upright, their removability enables a full adjustment range to be obtained. Thus for example, if one of the pegs would otherwise interfere with a desired repositioning of the horizontal rod through the corresponding through-hole, it may be temporarily removed from its hole in the rod, the readjustment of the rod made, and the peg reinserted into its hole in the rod.

Figure 16:
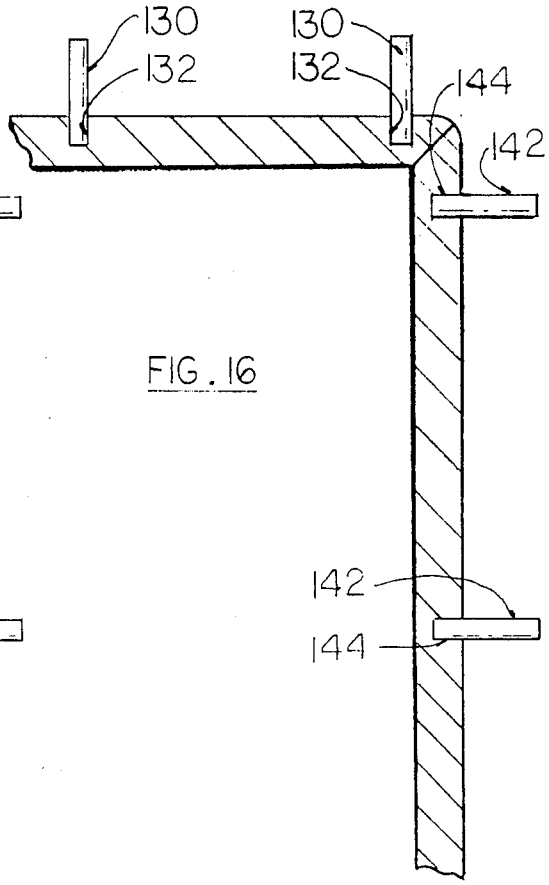

FIG. 16 illustrates an alternate configuration similar to FIG. 15 except that horizontal pegs 142 in the auxiliary upright are inserted into blind holes 144 rather than passing completely through through-holes.

A decorative lighting character may be imparted to a support. One example is shown in FIGS. 17 and 18 wherein a smaller neon tube 150 is concentrically disposed within a transpartent plastic member 152 which forms the horizontal rod and auxiliary vertical upright. Illumination of the tube 150 will cause its light to shine through the surrounding transparent tube 152.

FIG. 19 illustrates still another configuration in which flourescent fixtures 154 are mounted in the horizontal and vertical portions.

FIG. 20 illustrates a view in which an illuminated globe 160 is mounted atop the main upright.

Therefore the invention has been shown to provide a useful improvement which has both decorative and functional aspects. The invention is well suited for home and commercial uses. While preferred versions of the invention have been illustrated and described, it will be appreciated that the invention may be embodied in other equivalent ways.

What is claimed is:

1. A support structure comprising a main vertical upright having a series of vertically spaced, horizontally extending through-holes arranged at different angles about the axis of the main vertical upright, a series of horizontal rods extending through said through-holes so as to be adjustably positionable within the through-holes while also being supported by the main vertical upright, and for each rod, an auxiliary vertical upright spaced from said main vertical upright for providing further vertical support to the corresponding rod to one side of said main vertical upright in horizontally spaced relation to the vertical support provided by the main vertical upright, each rod being free of vertical support on a side of said main vertical support opposite where the rod's auxiliary vertical upright is providing vertical support, each auxiliary vertical upright providing vertical support for the corresponding rod via a non-articulated joint, and each rod being insertable into and removable from the corresponding through-hole via the portion thereof which is free of vertical support said main vertical upright comprises means for disposing said through-hole in adjustably positionable angular relationship with respect to each other about the axis of the main vertical upright, said means for disposing comprising said vertical upright comprising a plurality of vertically aligned sections, each section having at least one of said through-holes, there being means between adjacent sections allowing independent rotation of each section in relation to the other sections, each through-hole having at least one projection on an inner surface thereof, each horizontal rod having at least one longitudinal groove slidably engaging said at least one projection whereby said horizontal rods are prevented from rotating.

2. A support structure as set forth in claim 1 in which said auxiliary vertical uprights join with said horizontal rods at distal ends of the rods.

3. A support structure as set forth in claim 1 in which said rods are of equal lengths.

4. A support structure as set forth in claim 1 in which said main vertical upright is supported by a base.

5. A support structure as set forth in claim 1 including a roller on the bottom of each auxiliary vertical upright arranged for rolling motion in a direction which is parallel to the corresponding through-hole.

6. A support structure as set forth in claim 1 including a roller for supporting each auxiliary vertical upright for roling motion in directions which are both circular about the axis of the main vertical upright and radial to the axis of the main vertical upright.

7. A support structure as set forth in claim 1 including decorative lighting means on the support structure.

* * * * *